US005845550A

United States Patent [19]

Edwards

[11] Patent Number: 5,845,550

[45] Date of Patent: Dec. 8, 1998

[54] UNIVERSAL OIL FILTER WRENCH

[76] Inventor: Steven Wayne Edwards, 3800 Paulhill Rd., Richmond, Va. 23236

[21] Appl. No.: 923,818

[22] Filed: Sep. 4, 1997

[51] Int. Cl.[6] ..... B25B 13/52

[52] U.S. Cl. ..... 81/65; 81/64; 81/3.43

[58] Field of Search ..... 81/64, 65, 3.43, 81/177.7, 3.4, 65.2

[56] References Cited

U.S. PATENT DOCUMENTS

| | | | |
|---|---|---|---|
| 3,910,140 | 10/1975 | Rose . | |
| 4,012,971 | 3/1977 | Zeyher . | |
| 4,033,205 | 7/1977 | Hoskins . | |
| 5,307,712 | 5/1994 | Pratt . | |
| 5,309,797 | 5/1994 | Nguyen | 81/64 |
| 5,323,671 | 6/1994 | Hebert . | |
| 5,388,485 | 2/1995 | Auble . | |
| 5,507,210 | 4/1996 | Paramest . | |

*Primary Examiner*—David Scherbel
*Assistant Examiner*—Joni B. Danganan

[57] ABSTRACT

A tool for securing or removing a cylindrical object by grasping the object and rotating it about its central axis comprises a band clamp assembly and a hinged drive assembly. The band clamp assembly comprises a band clamp which is tightened by means of a thumbscrew or hex nut. The hinged drive assembly comprises at least four segments connected by at least three hinges. The end-segments of the hinged drive assembly have on their obverse surfaces raised slots through which the band clamp is slipped. The band clamp assembly then fits over and around a cylindrical object such as an oil filter canister. The clamp is tightened around the canister body such that the inner surface of the clamp and the reverse surfaces of the end-segments, which are knurled or scored, are in frictional contact with the canister wall. In the preferred embodiment—a hinged drive assembly having five segments connected by four hinges, rotation of the canister about its central axis is accomplished by one of three means. The tool may be engaged with a ratchet wrench, which fits into a square hole in the center mid-segment, or with a force bar implement, which slips through two rings attached to the obverse surface of the center mid-segment. Torque also may be applied manually by grasping the center mid-segment and employing the necessary wrist action.

14 Claims, 2 Drawing Sheets

UNIVERSAL OIL FILTER WRENCH

BACKGROUND OF THE INVENTION

1. Field of the Invention

This invention relates generally to a tool for securing or removing a cylindrical object—in particular, an oil filter canister—by grasping the object and rotating it about its central axis.

2. Description of the Related Art

Tools for securing and removing a cylindrical object such as an oil filter canister from its threaded counterpart are numerous in the art. The usefulness of any such tool, however, depends on its versatility, i.e., the range of spatial environments within which that tool can be used effectively and the range of external dimensions and configurations of objects which can be secured or removed with that tool. Severe limitations in versatility and other shortcomings in the prior art are described in more detail below.

An oil filter canister is typically secured to or removed from an engine block by rotating the canister clockwise or counterclockwise, as the case may be, about its central axis in relation to a threaded counterpart on the engine block. The canister must be secured tightly to its threaded counterpart. Otherwise, the engine oil will leak out from the points of contact when it circulates under pressure between the internal moving parts of the engine and the filter elements. More often than not, the turning force which can be applied by one's bare hand directly to the canister is insufficient to secure the canister tightly enough to its threaded counterpart, or to dislodge the canister from its tightened and secured position for removal. Significantly, traces of highly viscous engine oil on the smooth metal skin of the canister likely will prevent bare fingers from exerting the desired frictional grasp on the canister. Moreover, the accumulation of grime and grit between the points of contact likely will require the application of a greater turning force in order to dislodge the canister from its threaded counterpart.

To solve this basic problem, securing or removing the oil filter canister to or from its threaded counterpart typically calls for the use of a tool such as an oil filter wrench. In general, any such tool has two basic functions. First, it should provide its user with a sufficiently firm grasp on the canister body. For example, U.S. Pat. No. 5,388,485 to Auble discloses a band assembly that relies on a strip of sandpaper on the inner surface of the band clamp to provide the desired frictional grasp. This solution has obvious drawbacks. The sandpaper strip must be mounted onto the band assembly, thereby adding more parts to the assembly and complicating its construction. Moreover, the strip would require periodic changing because sandpaper loses its abrasive properties with repeated use.

As another example, U.S. Pat. No. 5,507,210 to Paramest discloses a pair of curved, laminated, toothed clamping bands to achieve the desired grasp. This solution, too, is imperfect because pressure from the tool's vise grip system can be applied to only two opposite, small areas on the canister surface that lie directly beneath the system's pair of "side connectors." Indeed, because the clamping bands are flexible, gripping pressure is not distributed uniformly along the entire length of the bands. A sufficiently firm grasp therefore is not guaranteed.

The tool's second basic function is to provide an efficient mechanism for translating the force exerted by the user into a torque that rotates the canister about its central axis. For example, U.S. Pat. No. 5,307,712 to Pratt discloses a U-shaped metal strip that functions as a handle. Grasping the metal strip, the user is able to deploy a torsional force by means of wrist action, and by muscular exertion from the entire arm and the shoulder. As the specification admits, however, the metal strip must be relatively flexible such that its "arms" can be drawn inwardly as the band assembly is tightened over a canister having a particular circumference. With this flexibility is a necessary tradeoff in mechanical performance—the arms of the metal strip are prone to twisting and warping from the torsional force applied by the user. Because it naturally deforms, the metal strip is not an optimally efficient mechanism for transferring the torsional force exerted by the user to the canister body.

U.S. Pat. No. 5,323,671 to Hebert illustrates yet another mechanism for deploying the desired torque. The patent discloses a flexible belt or strap to be wrapped around the canister and used in cooperation with a rigid, preferably metal, plate or buckle. The plate or buckle has an indentation to permit the engagement of a ratchet wrench, which is used to turn the canister. This mechanism is inefficient because the torsional force is applied along an axis running parallel to and beyond the canister wall rather than along the canister's central axis. The result is that the canister is rotated from a point on its circumference where the plate or buckle presses against the canister. The application of torque from this point is not only inefficient, but it may also deform the canister's relatively thin metal wall. Such damage to a used oil filter canister which is to be discarded can be tolerated. This result would not be acceptable, however, if it occurs during the installation of a new oil filter canister.

As the above examples illustrate, relatively recent innovations in oil filter wrenches and related tools have nevertheless left ample room for further improvement. A tool which provides a sufficiently firm grasp on canisters of all circumferences and configurations, without sacrificing any mechanical efficiency and stability, would be desirable. The tool should also permit its user to create a torque that operates along the canister's central axis—the axis of engagement with the canister's threaded counterpart. Off-center, a user would have to apply a greater torsional force, thereby unnecessarily taxing his or her energy.

Moreover, the tool should also be adaptive to the different spatial environments which its user may encounter. Frequently, the canister may be disposed in a cramped and hard-to-reach space within the engine. Access to the canister may be hindered by hoses, wires and other engine parts. Even with artificial lighting, the various engine parts are likely to create areas of shadow that may prevent the user to getting a sharp view of the canister and its surrounding environment. Thus, a tool could not be used if it were too cumbersome either to be maneuvered over and attached to the canister or to be operated by the user, assuming it could be attached to the canister in the first place.

For example, U.S. Pat. No. 5,307,712 to Pratt uses a band assembly that is tightened by means of a screw. In a dimly lighted and/or closely confined space, the user likely would have difficulty manipulating a screwdriver to effect the tightening or loosening of the band assembly. U.S. Pat. No. 5,388,485 to Auble discloses a handle assembly which ideally would permit its user to exert torsional force along an angular vector that is tangential and coplanar to the canister cross-section. A closely confined space, leaving little or no room around the canister body, would hinder the use of the tool in this preferred manner. To solve this problem, the Auble tool provides a handle that can be pivoted at an angle to permit as unobstructed a use as is possible within a particular environment. If the handle must be pivoted away from the plane of the canister cross-section, however, then the resulting force that is exerted along an angular vector coplanar to the canister cross-section will be smaller in magnitude. The user therefore would have to exert more torsional force.

As the above examples illustrate, a tool should adapt not only to the external dimensions and configuration of a given oil filter canister, but it should also adapt to the different spatial environments within which the user must operate. A tool with an optimally low profile would be desirable; it should hug the canister body as closely as possible. Moreover, a tool should provide its user with a choice of methods of use—ratchet wrench, manipulation by hand, screwdriver—so that the user can select the method best suited for a given spatial environment and a given set of working conditions. Nothing in the prior art exhibits these desired features of adaptability and universality. The invention disclosed below is a versatile tool having these and other desired features.

SUMMARY OF THE INVENTION

This invention is a tool comprises a band clamp assembly and a hinged drive assembly. The band clamp assembly provides the user of the tool with a sufficiently firm grasp on the canister body. It comprises a standard band clamp (often called a hose clamp) which can be adjusted to a wide range of varying diameters. The clamp is tightened, however, with a thumbscrew manipulated by hand. The thumbscrew adjustment feature permits a user to fit the tool over and around the oil filter canister more quickly and more simply than if the user had to use a screwdriver on the slotted worm gear normally used with standard band clamps. The shaft length of the thumbscrew adjustment is kept relatively short to preserve the tool's low physical profile.

Instead of a thumbscrew, the adjustment mechanism may be fitted with a hex nut. The user would tighten the clamp using a wrench. Again, the shaft length would be kept relatively short to preserve the tool's low physical profile. The shaft of either the thumbscrew adjustment or the hex nut adjustment could be placed in a vertical position relative to the band clamp. A vertical orientation would make the adjustment mechanism more accessible to the user in a closely confined space.

The hinged drive assembly provides the user of the tool with an efficient mechanism for translating the force exerted by the user into a torque that rotates the canister about its central axis. It comprises at least four rigid segments, which may be made from metal, impact-resistant polymer or some other suitable material known to one skilled in the art, connected by at least three hinges. Preferably, there are five rigid segments connected by four hinges. Embodiments with rigid segments exceeding five in number and hinges exceeding four in number are possible, but the segments must be of an odd number and the hinges correspondingly must be of an even number. In all of the embodiments, the segments at the ends are preferably T-shaped, the hinge being at the top of the "T". On the obverse surface, each end-segment has a raised slot through which the band clamp slips. The reverse surface of each end-segment is knurled or scored to provide an increased frictional grasp when the clamp is tightened around the oil filter canister. When the hinged drive assembly is fitted over the canister body and secured thereto with the band clamp assembly, the reverse surfaces of the end-segments are in contact with the canister wall. The T-shape of the end-segments minimizes their profile and maximizes the contact between the band clamp and the canister wall.

In the three-hinged embodiment, the middle two segments are identical rectangular segments. Each mid-segment has a rounded rectangular slot for receiving a force bar implement such as a screwdriver. The user slips the screwdriver through the slots of both mid-segments and applies the desired torque against the screwdriver. In the four-hinged embodiment, the first and third mid-segments are solid and roughly square in shape. The center mid-segment is larger than the other mid-segments and rectangular in shape. It has a square hole in its middle for the user to fit a ratchet wrench or similar device. The hole is reinforced to prevent it from "rounding out" through repeated use.

In the four-hinged embodiment, the center mid-segment can be fitted with rings through which a force bar implement such as a screwdriver can be inserted. Thus, the four-hinged embodiment permits the user to apply torque in as many as three different ways—by means of a ratchet wrench, a force bar implement, or manipulation by hand. Manipulation by hand is accomplished by grasping the center mid-segment and applying a torque using wrist action. In all three ways, the torque is applied along the canister's central axis—the axis of engagement with the canister's threaded counterpart.

This tool has the following advantages over the prior art. First, the tool is relatively easy to use. Both the band clamp assembly and the hinged drive assembly are relatively simple in their construction and operation. As long as the oil filter is accessible by hand, the user can slip this tool over and around the canister, and with a simple twist of the thumbscrew adjustment, obtain a sufficiently firm grasp on the canister body. The user then applies the torque to the canister by grasping the hinged drive assembly or by using a ratchet wrench or force bar implement. No fancy tools are needed.

Second, the tool has a low profile. Unlike other oil filter wrenches, neither the hinged drive assembly nor the band clamp assembly of this tool has any protruding or bulky features. Fitted over and around the canister, the tool readily conforms to the shape of the canister. The canister is then rotated using the hand and wrist, or with tools that are not cumbersome to use in closely confined spaces. A ratchet wrench, for example, can be fitted with an appropriate extension so that both the wrench and the user's full range of motion are not limited by any inhibiting structures.

Third, the tool has a universal fit. The range of canister dimensions and configurations that can be accommodated by one tool is limited only by the relative lengths and proportions of the hinged drive assembly and the band clamp assembly. Fourth, unlike other oil filter wrenches, this tool will not slip. When tightened around the canister body, the entire inner surface area of the band clamp and the knurled or scored surfaces of the end-segments of the hinged drive assembly are in contact with the canister wall. Maximizing the surface area of contact between the canister wall and the tool maximizes the frictional grasp. Moreover, because the gripping pressure is distributed evenly along the entire length of the band clamp, the tool does not damage the canister wall. Slippage and/or unequal application of pressure to the relatively thin canister wall can scar, deform or puncture the canister; the tool avoids these problems.

As mentioned above, the tool also permits the user to choose as many as three ways—ratchet wrench, force bar implement, manipulation by hand—for applying the necessary torque to the canister. The range of options allows the user to employ the method that best suits the circumstances and working conditions. Regardless of which method the user selects, however, the torque is applied efficiently along the canister's central axis, its axis of rotation. The user exerts less torsional force than that which would be required if the torque were applied along an axis parallel to and beyond the canister wall. The system is also mechanically more stable because the axis along which the torque is applied is the axis of rotation.

BRIEF DESCRIPTION OF THE DRAWINGS

The features of the tool summarized above will become clear from a thorough study of the description below of the preferred embodiments, reviewed in conjunction with the following drawings.

DESCRIPTION OF THE PREFERRED EMBODIMENTS

Figure 3:
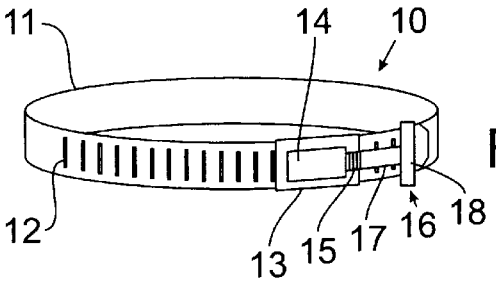
FIG. 3 is a close-up elevational view of the band clamp assembly having a thumbscrew adjustment mechanism.

Turning first to FIG. 3, the band clamp assembly 10 comprises a band clamp 11 having a plurality of vertical slots 12 and an adjustment mechanism 13. Beginning at one end of the clamp, the vertical slots 12 are spaced in regular intervals along some portion of the clamp's length. The adjustment mechanism 13 consists of a housing 14 which is mounted to the other end of the clamp. The housing 14 contains a threaded element 15, the threads of which engage the vertical slots 12 of the clamp when the slotted end of the clamp is inserted into the housing 14. The construction described thus far is that of a standard band clamp assembly, and it should be apparent, without further description, to one skilled in the art.

Figure 7:
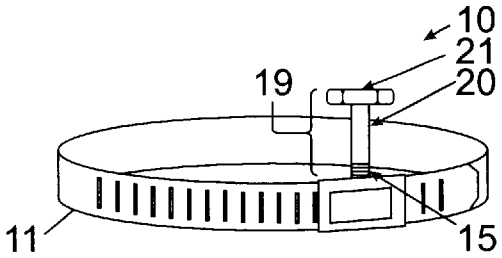
FIG. 7 is a close-up elevational view of the band clamp assembly having a hex nut adjustment mechanism that is in a vertical position relative to the band clamp.

Fitted over the threaded element 15 is a thumbscrew adjustment 16 having a shaft portion 17 and a thumbscrew 18. The thumbscrew adjustment 16 permits a user to tighten or loosen the band clamp 11 by turning the threaded element 15 in a clockwise or counterclockwise direction with his or her thumb. FIG. 7 describes another embodiment of the band clamp assembly 10. In this case, the thumbscrew adjustment 16 is replaced by a hex nut adjustment 19 having a shaft portion 20 and a hex nut 21. The hex nut adjustment 19 permits a user to tighten or loosen the band clamp 11 by turning the threaded element 15 with a wrench that engages the hex nut 21. Either the thumbscrew adjustment 16 or the hex nut adjustment 19 may be oriented in a vertical position relative to the band clamp 11, as also shown in FIG. 7.

Figure 4:
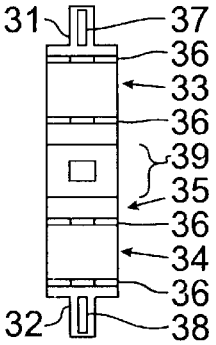
FIG. 4 is a close-up top plan view of the four-hinged drive assembly.

FIG. 4 illustrates one preferred embodiment of the hinged drive assembly 30, which comprises five segments connected to each other by four hinges so that they articulate with one another. As seen in this top plan view, the hinged drive assembly 30 has two end-segments 31 and 32, two distal mid-segments 33 and 34, and one center mid-segment 35. Four hinges 36 connect the end-segments 31 and 32 to the distal mid-segments 33 and 34, respectively, and the distal mid-segments 33 and 34 to the center mid-segment 35. The hinges 36 should be snugly fitted with minimal slop, and their diameters should be kept to a minimum necessary to withstand the magnitude of the torque to be exerted against the hinged drive assembly. The end-segments 31 and 32 are preferably T-shaped in configuration, and both have on their obverse surfaces raised slots 37 and 38, respectively. As mentioned above, the T-shape configuration minimizes the profile created by the end-segments 31 and 32 in contact with the canister wall, and it maximizes the contact between the band clamp 11 and the canister wall. The center mid-segment 35 has a portion 39 which has been reinforced, the middle of which is perforated to permit the snug engagement of a ratchet wrench.

Figure 1:
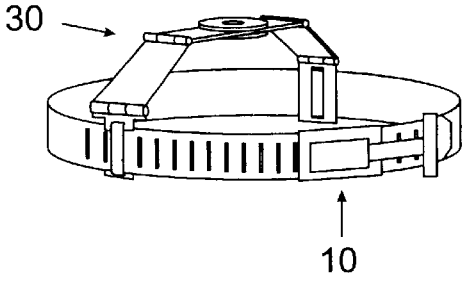
FIG. 1 is an isolated elevational view of the tool.
Figure 2:
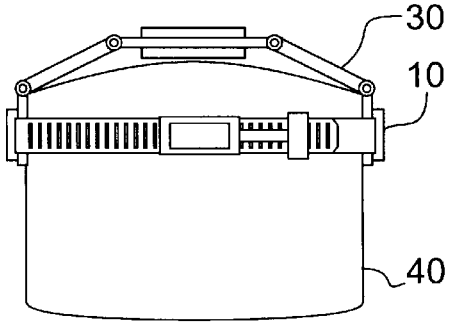
FIG. 2 is an elevational view of the tool gripping an oil filter canister.
Figure 5:
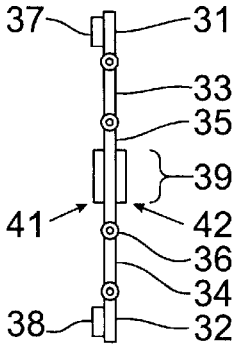
FIG. 5 is a close-up side view of the four-hinged drive assembly.
Figure 6:
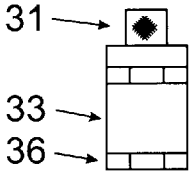
FIG. 6 is a close-up bottom plan view of the four-hinged drive assembly.

The raised slots 37 and 38 are illustrated more clearly in FIG. 5. The dimensions of these slots are large enough to permit the band clamp 11 to slip through, as illustrated in FIG. 1. FIG. 5 also shows the construction of the reinforced portion 39 of the center mid-segment 35. In this embodiment, the reinforced portion 39 consists of a portion of the center mid-segment 35 sandwiched between two additional pieces 41 and 42 of the same constructing material, welded, fused or otherwise joined by any means sufficient to bond pieces of such material together into a integral whole. It should be noted that the laminated construction illustrated in FIG. 5 represents only one solution to achieving the desired reinforced portion 39 of the center mid-segment 35. Other solutions will be obvious to one skilled in the art, and would not take the design beyond the scope of this invention. FIG. 6 illustrates, in particular, the reverse surfaces of the end-segments 31 and 32 of the hinged drive assembly 30, which are scored or knurled to provide an increased frictional grasp on the canister body 40 when the band clamp is tightened around the canister wall, as shown in FIG. 2.

Figure 8:
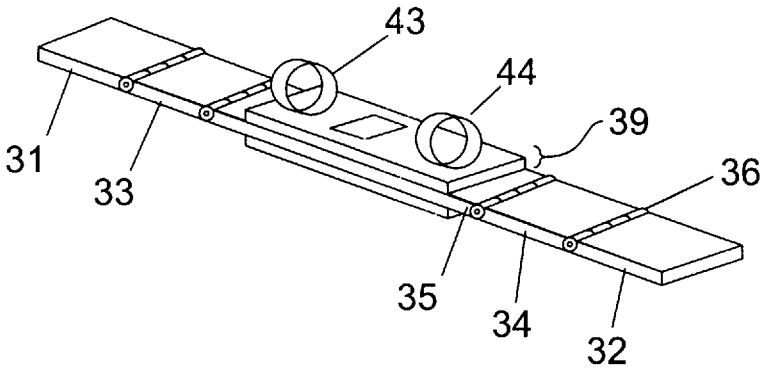
FIG. 8 is a close-up elevational view of another embodiment of the four-hinged drive assembly.

Turning now to FIG. 8, the four-hinged drive assembly of FIG. 4 is fitted with rings 43 and 44 on the obverse surface of the laminated and reinforced portion 39 of the center mid-segment 35. Rings 43 and 44 are welded, mounted, or otherwise joined to the laminated and reinforced portion 39 by any means known to one skilled in the art to be sufficient to secure them to the laminated and reinforced portion 39. The user of the tool can then insert a force bar implement such as a screwdriver into rings 43 and 44 for the purpose of applying the desired torque to the canister.

Figure 9:
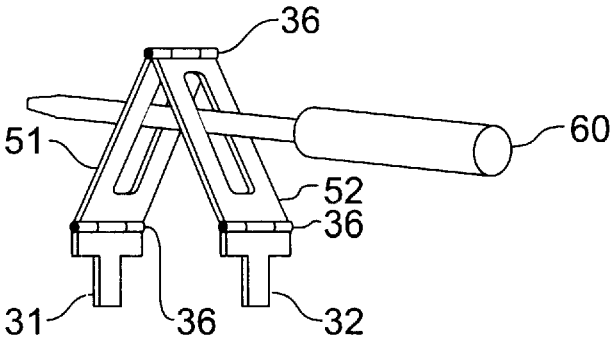
FIG. 9 is a close-up elevational view of a three-hinged drive assembly, illustrating its use with a force bar implement such as a screwdriver.

FIG. 9 illustrates a three-hinged embodiment of the hinged drive assembly 30. It has two end-segments 31 and 32 and two mid-segments 51 and 52, connected to each other by hinges 36 according the arrangement shown in FIG. 9. The two mid-segments 51 and 52 each are perforated in their middle to permit the engagement of a force bar implement such as a screwdriver 60 in the manner shown. Although this embodiment will enable its user to secure or remove the canister by rotating it about its central axis, either a force bar implement or manipulation by hand must be used. The tool will not accommodate a ratchet wrench. Thus, this embodiment is not as versatile as a hinged drive assembly having at least four hinges.

It will be obvious to the reader that this tool, as is the case with tools generally, can be appropriately sized for its intended uses. The material from which the tool is constructed can be metal, an impact-resistant polymer, or anything else that is generally suitable and known to one skilled in the art for use in constructing durable tools sufficient to withstand the mechanical forces to be exerted on them. Although the referenced drawings illustrate the tool's use with an oil filter canister, the tool obviously can be used to grasp and rotate cylindrical objects of varying dimensions and configurations in all sorts of work environments.

Although the tool has been described in the above specification and illustrated in the referenced drawings in connection with certain preferred embodiments, it is to be understood that modifications and variations may be made to it without departing from the spirit of the invention, as those skilled in this art will readily understand. Such modifications and variations are considered to be within the purview and scope of the present invention as defined by the claims below.

I claim:

1. A tool for securing or removing a cylindrical object by grasping the object and rotating it about its central axis, comprising a band clamp assembly which comprises a band clamp having a plurality of vertical slots and an adjustment mechanism by which the clamp can be tightened around the object or loosened therefrom; and a hinged drive assembly which comprises an odd number of rigid segments, the number being equal to or greater than five, which are connected to each other by an even number of hinges, the number being correspondingly equal to or greater than four, so as to permit their articulation with one another, two of the segments being end-segments having on their obverse surfaces raised slots through which the band clamp can be slipped through and having on their reverse surfaces scoring or knurling, and one of the segments being a center mid-segment having a reinforced portion, the middle of which is perforated to permit snug engagement with a ratchet wrench.

2. The tool of claim 1, wherein the adjustment mechanism of the band clamp assembly has a shaft portion ending in a thumbscrew.

3. The tool of claim 2, wherein the shaft portion of the adjustment mechanism is oriented in a vertical position relative to the band clamp.

4. The tool of claim 1, wherein the adjustment mechanism of the band clamp assembly has a shaft portion ending in a hex nut.

5. The tool of claim 4, wherein the shaft portion of the adjustment mechanism is oriented in a vertical position relative to the band clamp.

6. The tool of claim 1, wherein the reinforced portion of the center mid-segment has fitted on its obverse surface, on opposite sides of its perforated middle, two rings to permit engagement with a force bar implement.

7. The tool of claim 1, wherein the number of rigid segments is five and the number of hinges is four.

8. The tool of claim 1, wherein the end-segments are T-shaped.

9. A tool for securing or removing a cylindrical object by grasping the object and rotating it about its central axis, comprising a band clamp assembly which comprises a band clamp having a plurality of vertical slots and an adjustment mechanism by which the clamp can be tightened around the object or loosened therefrom; and a hinged drive assembly which comprises four rigid segments which are articulably connected to each other by three hinges, two of the segments being end-segments having on their obverse surfaces raised slots through which the band clamp can be slipped through and having on their reverse surfaces scoring or knurling, and the other two segments being mid-segments, the middle of each of which is perforated to permit engagement with a force bar implement.

10. The tool of claim 9, wherein the adjustment mechanism of the band clamp assembly has a shaft portion ending in a thumbscrew.

11. The tool of claim 10, wherein the shaft portion of the adjustment mechanism is oriented in a vertical position relative to the band clamp.

12. The tool of claim 9, wherein the adjustment mechanism of the band clamp assembly has a shaft portion ending in a hex nut.

13. The tool of claim 12, wherein the shaft portion of the adjustment mechanism is oriented in a vertical position relative to the band clamp.

14. The tool of claim 9, wherein the end-segments are T-shaped.

* * * * *